US007108043B2

(12) United States Patent
Willems et al.

(10) Patent No.: US 7,108,043 B2
(45) Date of Patent: Sep. 19, 2006

(54) METHOD AND DEVICE FOR THE WEIGHT-CONTROLLED FILLING OF INGOT MOLDS IN NON-IRON CASTING MACHINES

(75) Inventors: Erich Willems, Oberstadtfeld (DE); Adolf Gustav Zajber, Langenfeld (DE); Heinz Josef Leuwer, Lissendorf (DE); Ronald Wilmes, Solingen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/513,062
(22) PCT Filed: Mar. 12, 2003

(86) PCT No.: PCT/EP03/02522
§ 371 (c)(1),
(2), (4) Date: Oct. 27, 2004

(87) PCT Pub. No.: WO03/092928
PCT Pub. Date: Nov. 13, 2003

(65) Prior Publication Data

US 2005/0126739 A1 Jun. 16, 2005

(30) Foreign Application Priority Data

Apr. 27, 2002 (DE) ..... 102 18 958

(51) Int. Cl.
*B22D 37/00* (2006.01)

(52) U.S. Cl. ..... 164/136; 164/457

(58) Field of Classification Search ..... 164/136, 164/335, 337, 457, 155.7
See application file for complete search history.

(56) References Cited

U.S. PATENT DOCUMENTS 3,876,109 A * 4/1975 Kreuz et al. ..... 222/604

(Continued)

FOREIGN PATENT DOCUMENTS

DE 1956076 5/1971

(Continued)

OTHER PUBLICATIONS

Patent Abstracts of Japan, vol. 004, No. 125 (M-030), Sep. 3, 1980 & JP 55 084268 A (Sumitomo Metal Mining Co Ltd), Jun. 25, 1980.

(Continued)

*Primary Examiner*—Kevin Kerns
*Assistant Examiner*—I.-H. Lin
(74) *Attorney, Agent, or Firm*—Friedrich Kueffner

(57) ABSTRACT

The invention relates to a method for the weight-accurate filling of ingot molds in a non-iron casting machine, e.g. a copper anode casting machine or a zinc anode casting machine, which is configured in the form of casting wheels that are use for production in a fully mechanized casting operation and are provided with the ingot molds. The aim of the invention is to obtain the desired precise-weight quality of a piece and exact plane parallelism of the bordering surfaces thereof. Said aim is achieved by carrying out the following steps: first, a liquid metal is introduced into an intermediate trough (4, 4') at a regulated mass flow rate, the continuous dynamic weight increase being simultaneously determined; second, liquid metal is fed into a dosing trough (4, 4') which is located on each side of the intermediate trough (4, 4') by alternately tilting the intermediate trough (4, 4') on one side followed by the other. After filling the first dosing trough (5), the intermediate trough (4) is tilted in the direction of the second dosing trough (5') while the mass of an anode is cast from the first filled dosing trough into one of the ingot molds (10, 10') that are arranged on the casting wheel (9, 9') by means of a controlled tilting movement. Also disclosed is a device for carrying out the inventive method.

5 Claims, 9 Drawing Sheets

U.S. PATENT DOCUMENTS 4,186,791 A * 2/1980 Sladkoshteev et al. ..... 164/475
5,287,896 A * 2/1994 Graffin ..... 141/9

FOREIGN PATENT DOCUMENTS

DE 2011698 9/1971
JP 57079065 * 5/1980

OTHER PUBLICATIONS

Patent Abstracts of Japan, vol. 006, No. 163 (M-152), Aug. 26, 1982 & JP 57 079065 A (Yamato Scale Co Ltd), May 18, 1982.

* cited by examiner x
9
10
10'
5
5'
6
6'
12
12'
4
4'
x
11

METHOD AND DEVICE FOR THE WEIGHT-CONTROLLED FILLING OF INGOT MOLDS IN NON-IRON CASTING MACHINES

CROSS REFERENCE TO RELATED APPLICATION

This application is a 371 of PCT/EP03/02522 filed on Mar. 12, 2003.

BACKGROUND OF THE INVENTION

The invention concerns a method for the exactly weight-controlled filling of ingot molds of a nonferrous casting machine, for example, a copper anode casting machine or a zinc anode casting machine, which is designed in the form of casting wheels for production in a fully mechanized casting operation and is equipped with ingot molds, wherein, in a first step, molten metal is introduced into an intermediate trough at a regulated mass flow rate with simultaneous determination of the continuous dynamic weight increase, and, in a second step, molten metal is alternately fed into metering troughs located on either side of the intermediate trough by tilting the intermediate trough first to one side and then to the other, and after the first metering trough has been filled, the intermediate trough is tilted towards the second metering trough, and at the same time the mass of an anode is cast from the metering trough that was filled first into one of the ingot molds located on the casting wheel by a controlled tilting movement.

The invention also concerns a device for carrying out the method of the invention.

In contrast to the production of individual castings, for example, castings produced in relatively small piece numbers in sand molds, anodes made of nonferrous metals are produced in relatively large piece numbers in a fully mechanized casting operation with the use of cast iron, copper, or steel ingot molds that can be used many times. The features that characterize the desired quality of the anodes are exact piece weight and exact plane parallelism of the surfaces of the anodes.

Constant values of these parameters are achieved in an especially advantageous way with the use of casting machines equipped with casting wheels. In this regard, in the peripheral area, for example, of one or two casting wheels equipped with ingot molds, stationary opposite casting troughs are provided in a tiltable system, which are alternately filled with casting metal as the ingot molds pass beneath them and are then poured out into one of the ingot molds as it comes to a stop.

The natural limits of the well-known production process are set by the speed difference between the stationary casting troughs and the ingot molds passing beneath these casting troughs with the casting wheel. The speed difference forces the maximum achievable output of anode casting according to the weight, quantity, and quality of the pieces, especially as a function of the necessary standing time of the casting wheel and the moving times, including the times required for accelerations and decelerations.

The cycle time, i.e., the period of time between the positioning of, for example, two ingot molds, is calculated here from the standing time of the casting wheel for the purpose of filling, inspection, and removal, and the moving times, accelerations, and decelerations, taking into account the fact that there is some overlapping of the moving times and the filling.

The document DE 1 956 076 A1 describes a method and equipment for producing a relatively large number of copper anode plates. This method uses casting wheels, whose molds are successively filled with molten copper at a point on the circumference of the wheel and then further rotated by the distance between two molds. In short intervals, metered amounts of molten metal are alternately delivered from a single removal site into at least two casting wheels, so that one casting wheel is rotated further as long as the casting operation is occurring at the other casting wheel.

To achieve exactly weight-controlled casting of copper anode plates in the individual molds of a casting wheel, it is known from German Auslegeschrift 2 011 698 that the desired weight of the anode plates can be determined before the casting metal is poured into a mold independently of the actual weight of a previously cast anode plate by weighing out an absolutely adjustable partial amount of a total amount that is two to three times the partial amount.

The document JP 55[1980]-084,268 describes a method for increasing the efficiency of a casting machine with a casting wheel by the use of two casting positions. In the casting machine, an intermediate trough, which is provided with transversely directed outlets, is arranged below an outlet in such a way that it can be tilted about its horizontal axis. Metering troughs for weighing the metal are arranged below each outlet of the intermediate trough and can be tilted about the axis. An ingot mold is arranged below the outlet of each metering trough.

The document DE 1 956 076 A1 discloses a method and equipment for producing a relatively large number of copper anode plates. In this method, metered amounts of molten metal are alternately delivered from a single removal site into at least two casting wheels, so that one casting wheel is rotated further as long as the casting operation is occurring at another casting wheel or at the other casting wheel.

During this operation, the supply of molten metal for metering is controlled by weighing the total amount on which the metering is based, and the available amount of molten metal, from which the partial amount is to be separated, is held constant.

SUMMARY OF THE INVENTION

Proceeding on the basis of the prior art described above, the objective of the invention is to specify an improved operating method and an improved design for nonferrous casting machines for the purpose of increasing the quality of the product and to a achieve exactly weight-controlled filling of the ingot molds.

This objective is achieved in the present invention by dividing the mass flow during casting into preferably three phases: In a first phase, the casting metal is first cast into an ingot mold at a relatively low mass flow rate; in a second phase, after a predetermined metal mass or metal weight has been reached, uniform filling of the ingot mold at a relatively higher mass flow rate is undertaken; and, in a third phase, after a predetermined weight of molten metal has again been reached, slow filling at a reduced mass flow rate is carried out to obtain the precise weight desired.

The operating method of the invention makes it possible to guarantee a fully mechanized casting operation with comparatively high piece numbers with the use of cast iron, copper, or steel ingot molds that can be reused many times, where the cast anodes have an exact piece weight and show exact plane parallelism of their boundary surfaces, i.e., they have those features that characterize the desired quality of the cast anodes.

A refinement of the method provides that only one metering trough at a time is alternately filled from the intermediate trough, while the slow, exactly weight-controlled filling of an ingot mold is being carried out by the other metering trough.

In the case of a triangular arrangement of the metering troughs on a casting wheel, only after both metering troughs are filled, are the next two empty ingot molds brought into position.

In the case of metering troughs arranged in the form of a Y on two casting wheels, immediately upon completion of the filling operation of one metering trough, the next empty ingot mold is brought into position under the given presently filled metering trough.

In an especially advantageous refinement of the invention, the period of time between the positioning of two ingot molds is calculated as the so-called cycle time from standing times of a casting wheel and moving times for positive or negative acceleration, for example, for filling, inspection, or removal, and overlapping of the moving times and especially of the filling is taken into consideration. Especially overflowing of the melt beyond the tolerances of the tilting or overflow edges of the ingot molds is avoided in this way, and plane parallel anode surfaces can be guaranteed.

Further refinements of the method of the invention are specified in the dependent claims.

A casting machine for carrying out casting operations for the purpose of producing anodes made of nonferrous metal, such as copper anodes or zinc anodes, is characterized by the fact that a stepped casting edge is provided on the front outlet of each metering trough.

In accordance with a further refinement of the casting machine in accordance with the invention, it is proposed that means, e.g., hydraulic cylinders, be provided for tilting each intermediate trough about its longitudinal axis; that means, e.g., hydraulic cylinders, be provided for tilting each metering trough about its transverse axis; that means, e.g., weighing cells, be provided to detect the current weight content of the intermediate troughs; and that means, e.g., weighing cells, be provided to detect the current weight content of the metering troughs.

The invention is illustrated in schematic drawings of a preferred embodiment, which also reveal other advantageous details of the invention.

DETAILED DESCRIPTION OF THE INVENTION

Figure 1:
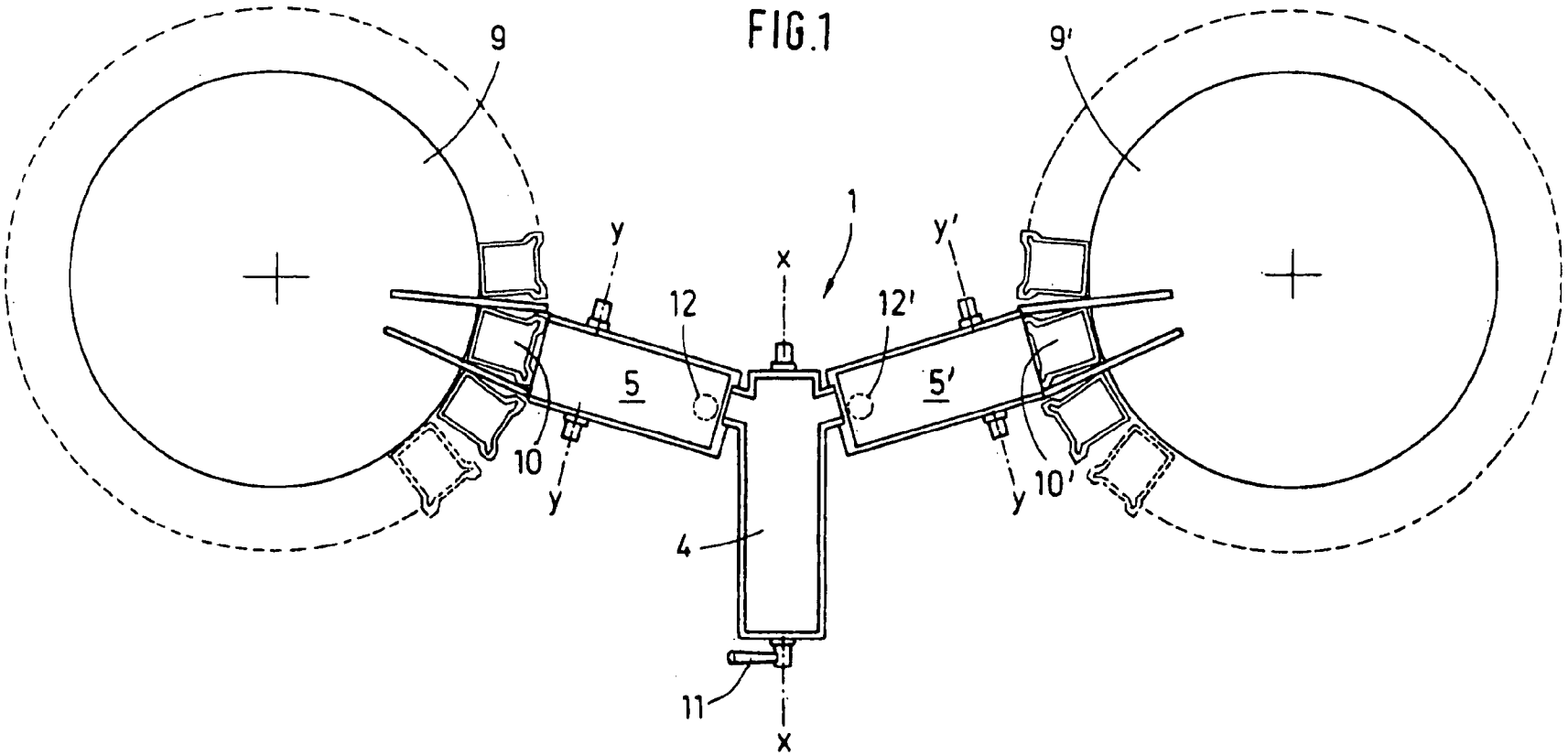
FIG. 1 shows a top view of the casting device of a metal casting machine with two casting wheels with a V-shaped configuration of the metering troughs.
Figure 2:
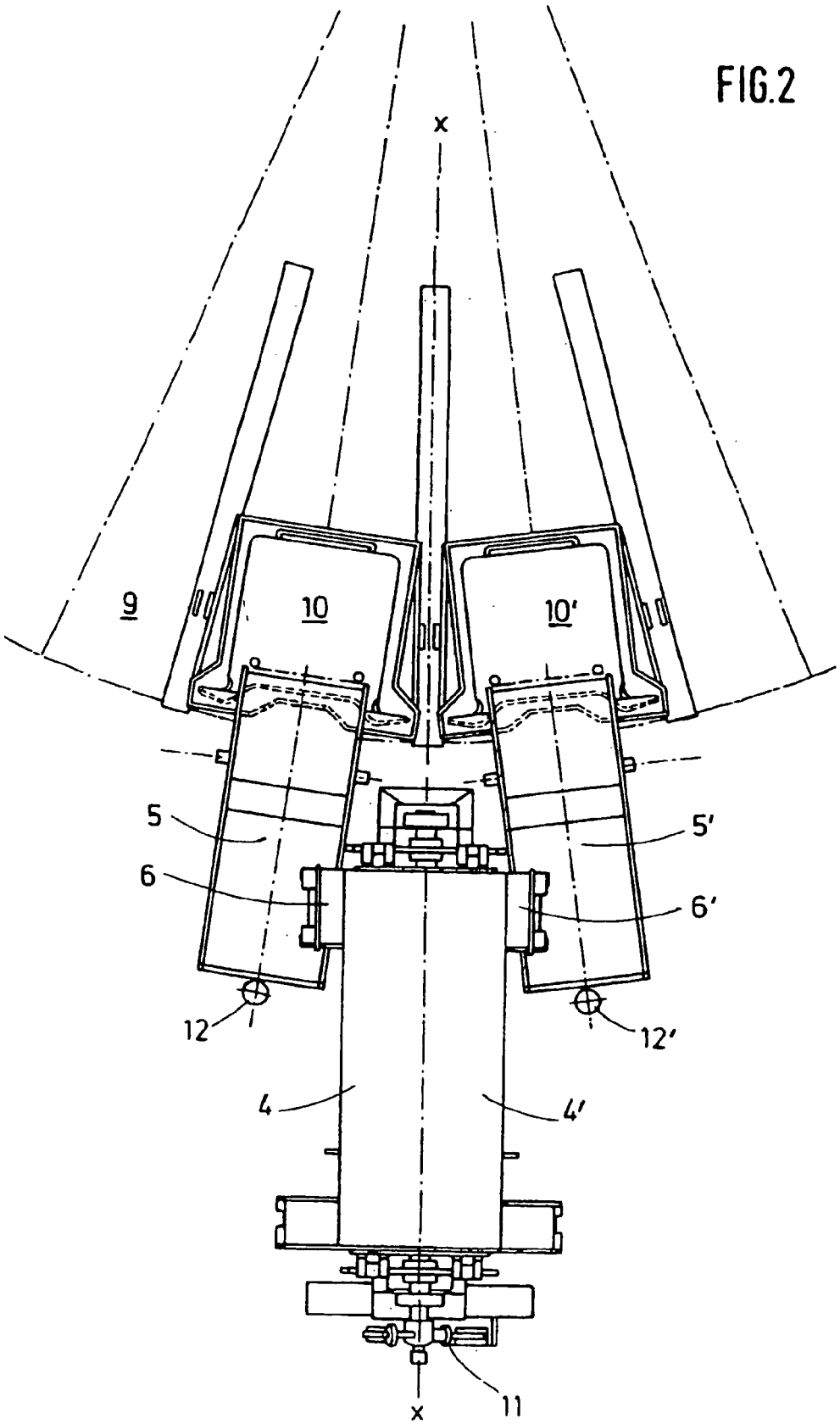
FIG. 2 shows a top view of a casting device with a casting wheel in a delta-shaped configuration of a pair of metering troughs.

The top view of FIG. 1 shows the essential functional elements of a metal casting machine 9, 9' in functional V-connection of the metering troughs 5, 5' with an intermediate trough 4. The intermediate trough can be tilted to either side by means of a rocker bearing of its axis x—x to empty molten metal into the metering troughs 5, 5' through the outlets 6, 6'. Hydraulic cylinders 12, 12', which preferably have automatic position control, are installed on one side of a metering trough as a means for tilting. The intermediate trough 4 is rotationally supported at two points on a frame 16 to allow it to swivel about its longitudinal axis x—x, and a hydraulic cylinder 11 is used as a third mounting point. The frame 16 is also supported on at least three points on weighing cells 13. The weighing cells are arranged within the overall system in such a way that no transverse forces act on the weighing cells and thus no measuring errors occur.

The metering troughs 5, 5' are supported by the transverse axes y—y, so that they can be tilted from the horizontal position into an emptying position in which they are forwardly inclined. After the intermediate trough is tilted about the longitudinal axis x—x, molten metal is poured towards one side through one of the outlets 6, 6' and into the corresponding metering trough 5, 5'.

A regulated weight of molten metal is delivered from these metering troughs into one or the other of the ingot molds 10, 10', which are provided on the periphery of each casting wheel 9, 9' and rotate with the casting wheel. During this operation, an amount of molten metal with an exact weight is delivered by alternately tilting the intermediate trough 4, 4' to one side and then the other by means of a lifting cylinder 11. At the same time, an anode is cast by a controlled tilting movement into one of the ingot molds 10, 10' from the first metering trough 5, 5' to be filled.

In this first phase, the molten metal is first cast into an ingot mold at a relatively low mass flow rate to avoid spashing or overflowing. In a subsequent phase, after a predetermined intermediate weight has been reached, uniform filling of the ingot molds 10, 10' is carried out at a higher mass flow rate. After a predeterminable metal casting weight has again been reached at the end of this phase, slow filling is carried out in a third phase to obtain the precise weight desired. For this purpose, the point at which the flow of metal is interrupted is selected in such a way that the predetermined weight tolerance is maintained. The critical parameters for this are:

anode weights;

different output amounts of molten metal in a metering trough 5; and geometry of the metering trough, in this regard, the casting edge 8, 8' of the metering trough 5, 5' is designed in such a way that the kinetic energy is reduced during the tilting operation, and the molten metal flows as vertically as possible into the ingot mold.

Figure 5:
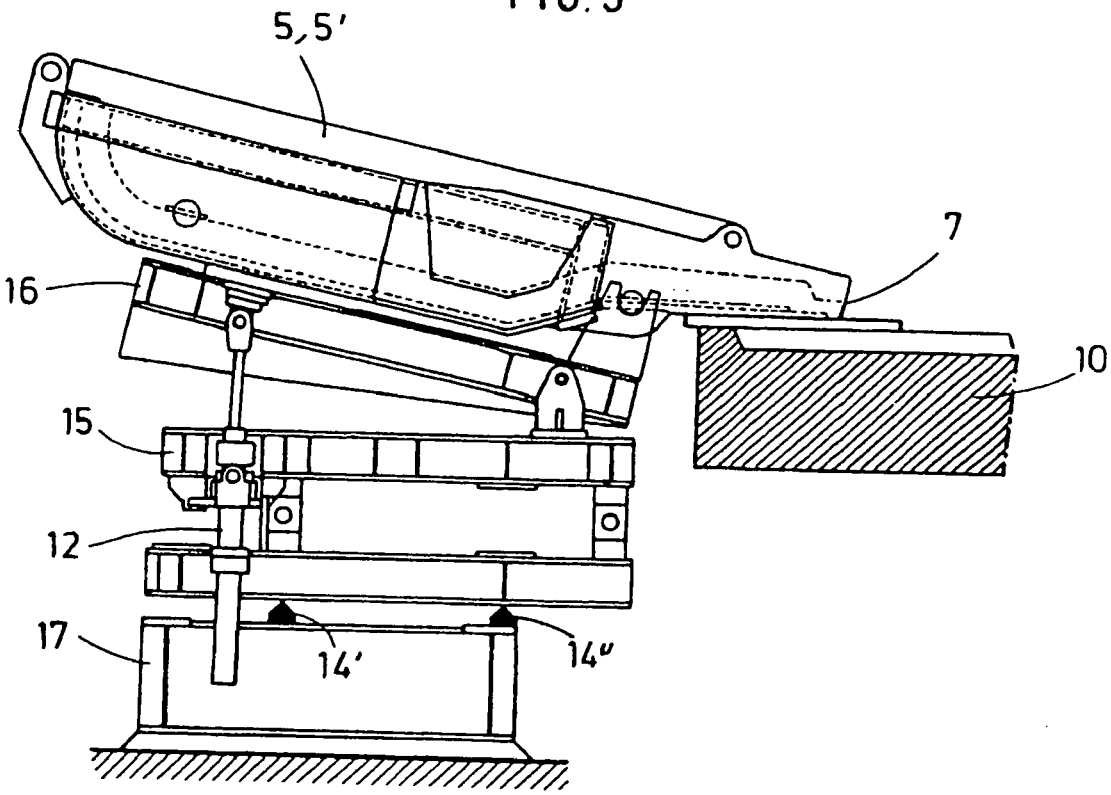
FIG. 5 shows a side view of a metering trough in its tilted emptying position.

In this connection, it is advantageous for the casting edge 8, 8' of the metering trough 5, 5' to be designed in such a way that the kinetic energy of the pouring stream during tilting is reduced as much as possible, and the molten metal flows as vertically as possible into the ingot mold, as illustrated in FIG. 5. One metering trough 5, 5' at a time is alternately filled from the intermediate trough 4, while the slow, exactly weight-controlled filling of the first ingot mold 10, 10' is being carried out by the other metering trough.

In this operation, the next empty ingot molds 10 are brought into position only after the two metering troughs 10, 10' are first filled, and, on the other hand, the next ingot mold is positioned under the given presently filled metering trough.

With respect to the positioning, it is important to make sure that at given positive and negative acceleration states of the casting wheel 9, 9', the tilting edges of the anodes are maintained within acceptable tolerance limits, and that the production of plane parallel anode surfaces is guaranteed.

The cycle times between the positioning of two ingot molds are calculated from the standing time of the casting wheel 9, 9', e.g., for filling, inspection, and removal, and the moving times, such as positive and negative acceleration, taking into account the fact that there is some overlapping of the moving times and the times for the filling.

Figure 3:
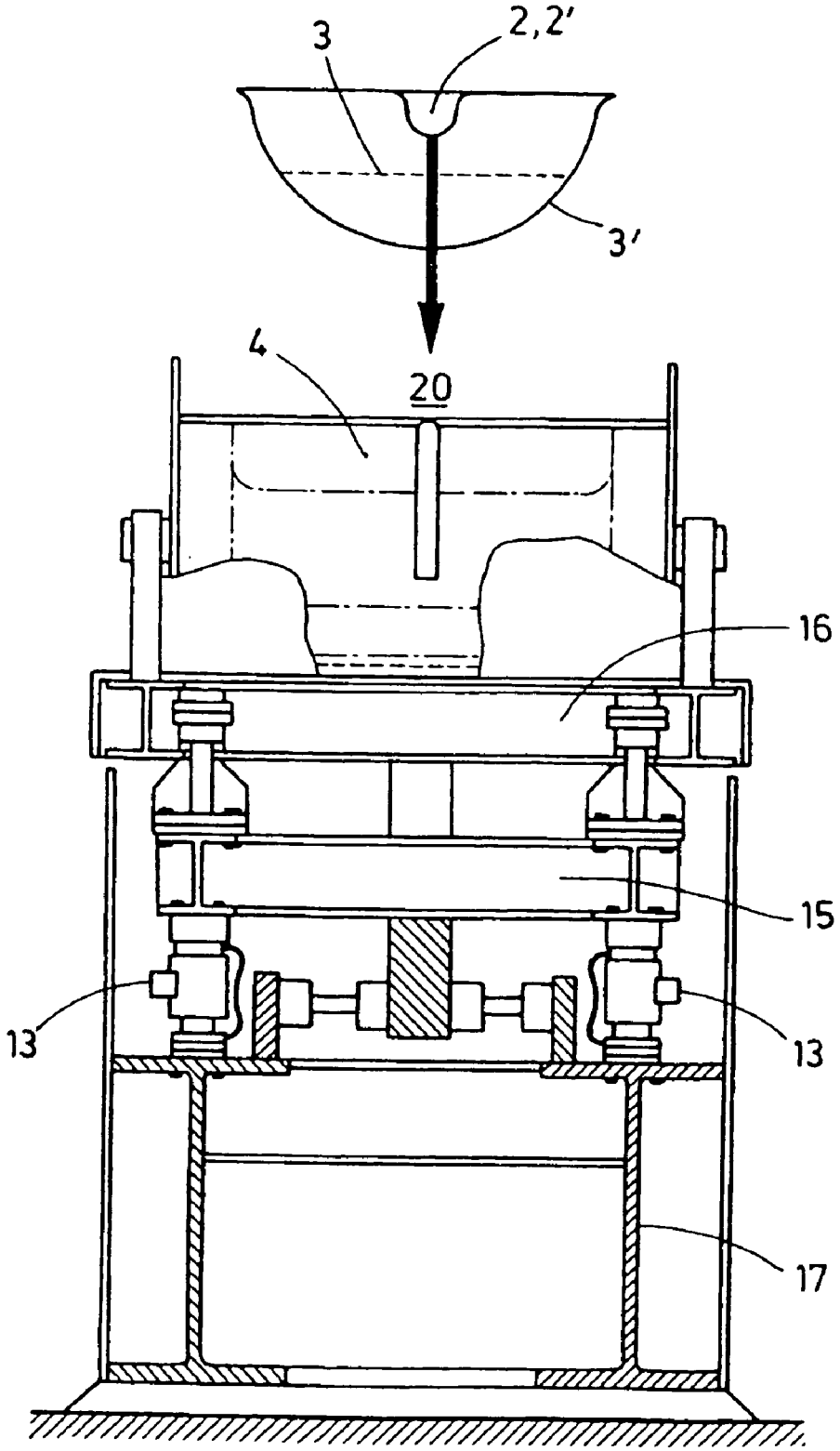
FIG. 3 shows a rear view of a metering trough.
Figure 4:
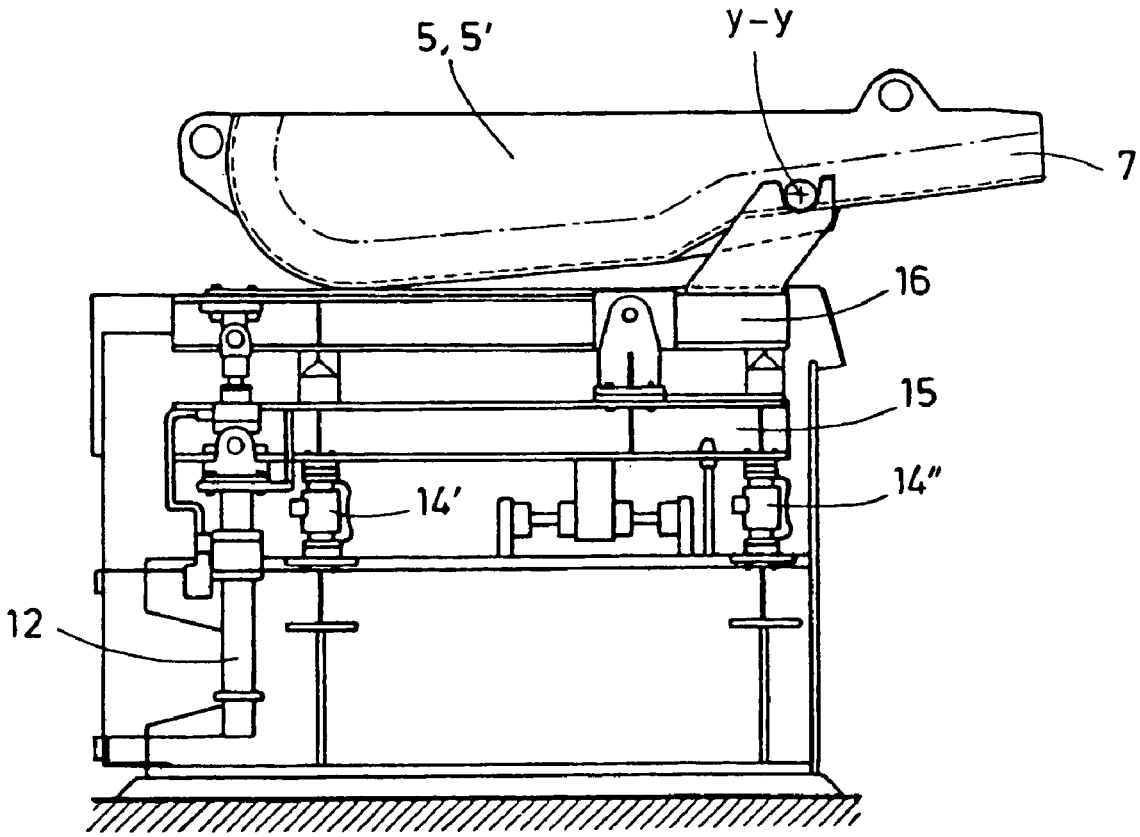
FIG. 4 shows a side view of the metering trough in the horizontal position.
Figure 6:
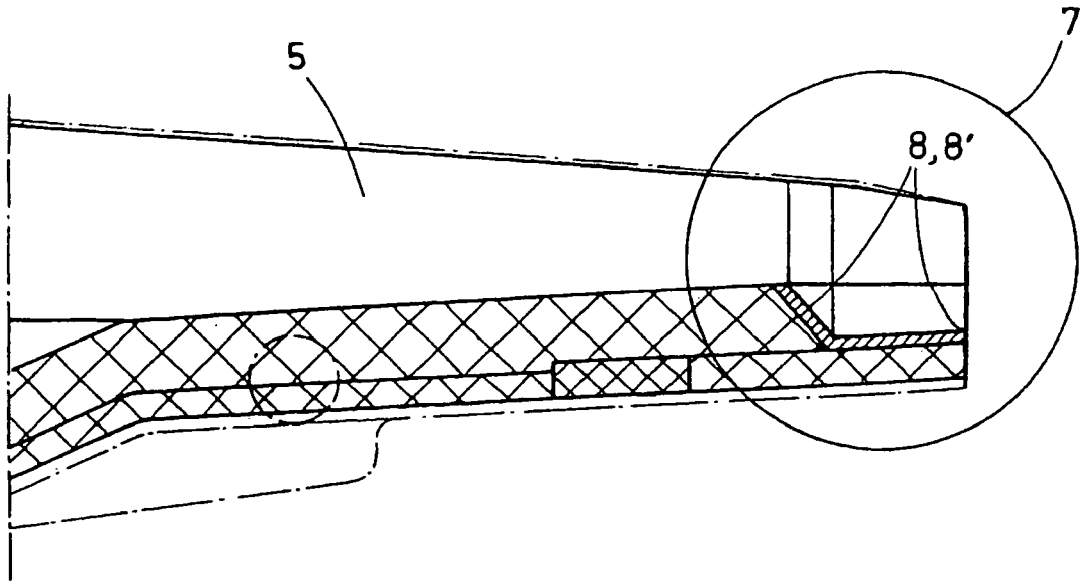
FIG. 6 shows an enlarged transverse section of the front outlet of a metering trough.
Figure 7:
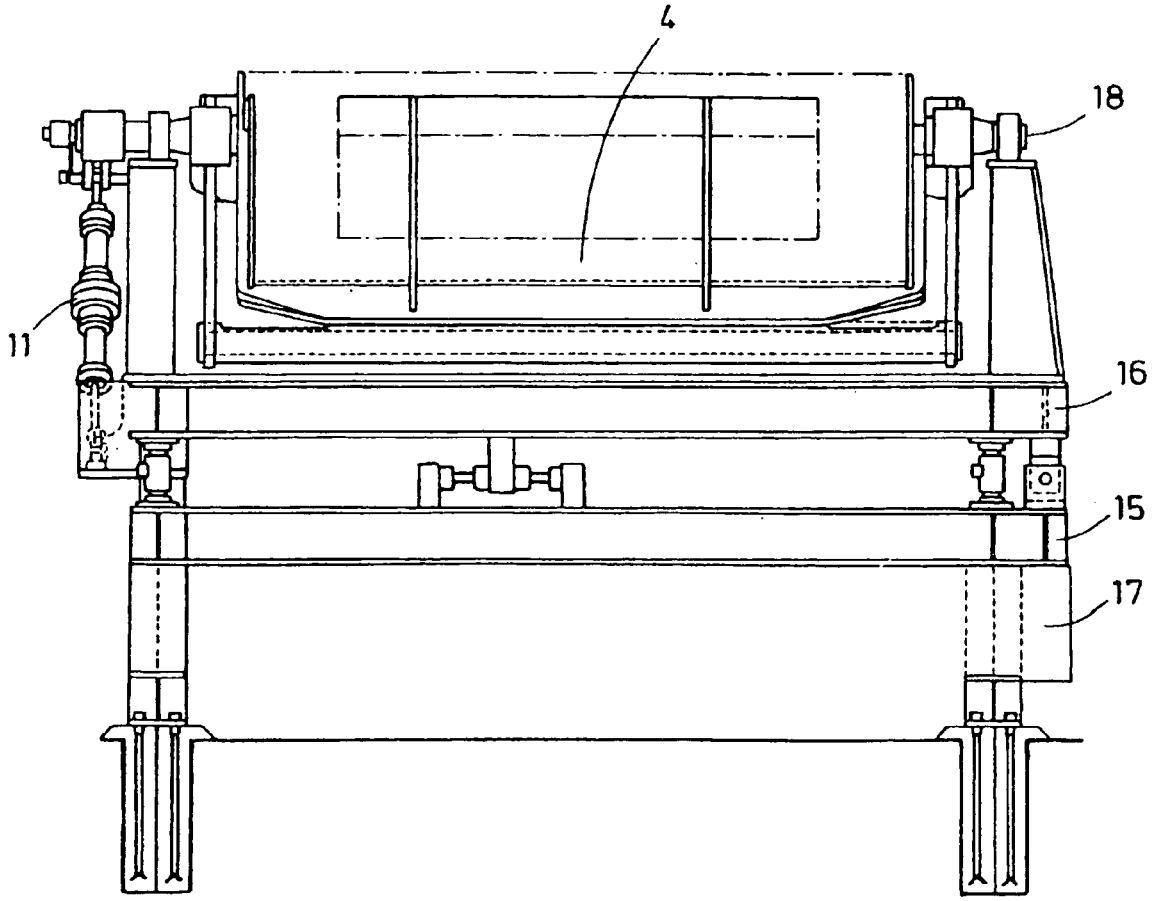
FIG. 7 shows a side view of an intermediate trough with a swivel bearing.
Figure 8:
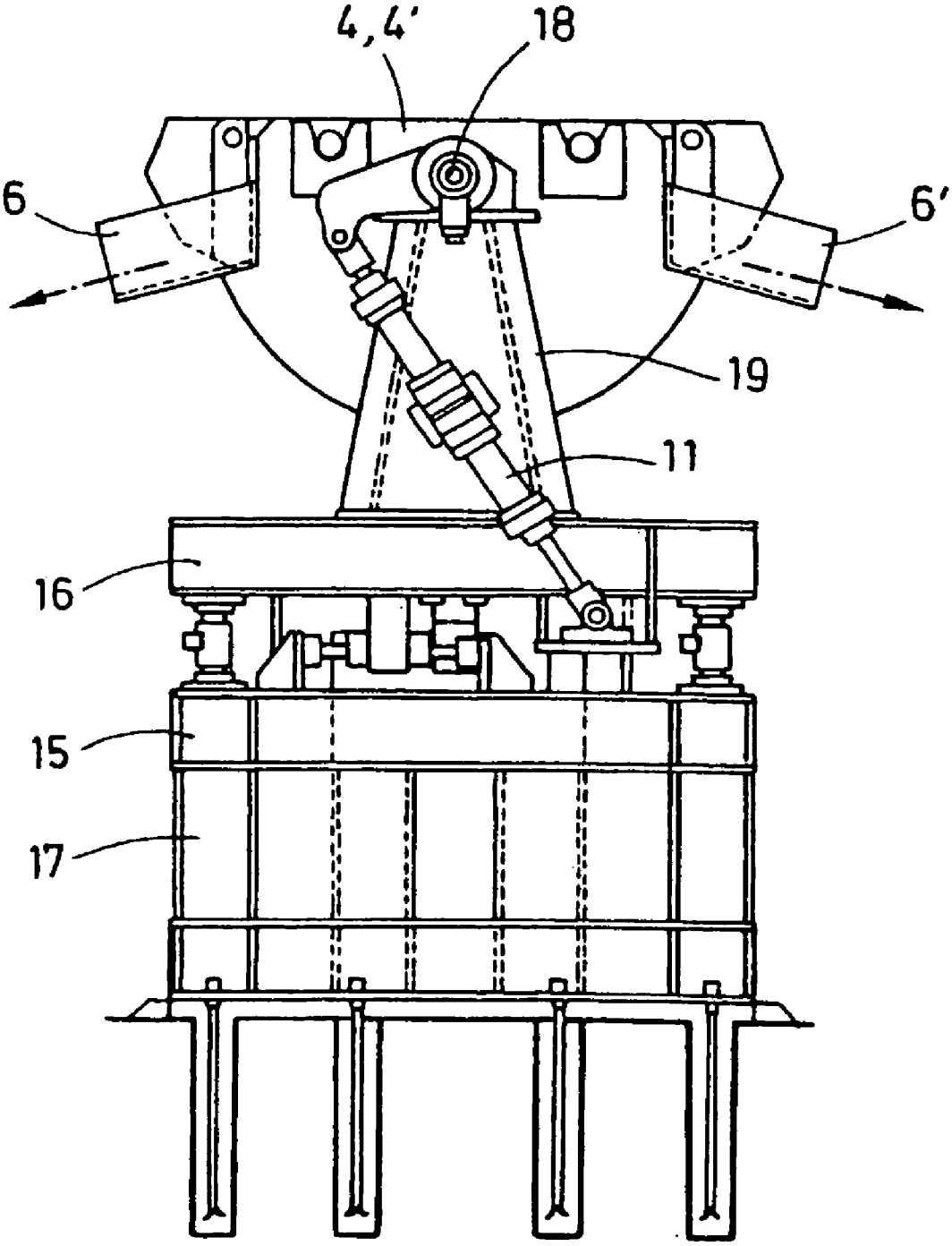
FIG. 8 shows a rear view of the intermediate trough with swivel bearing and swivel drive.
Figure 9:
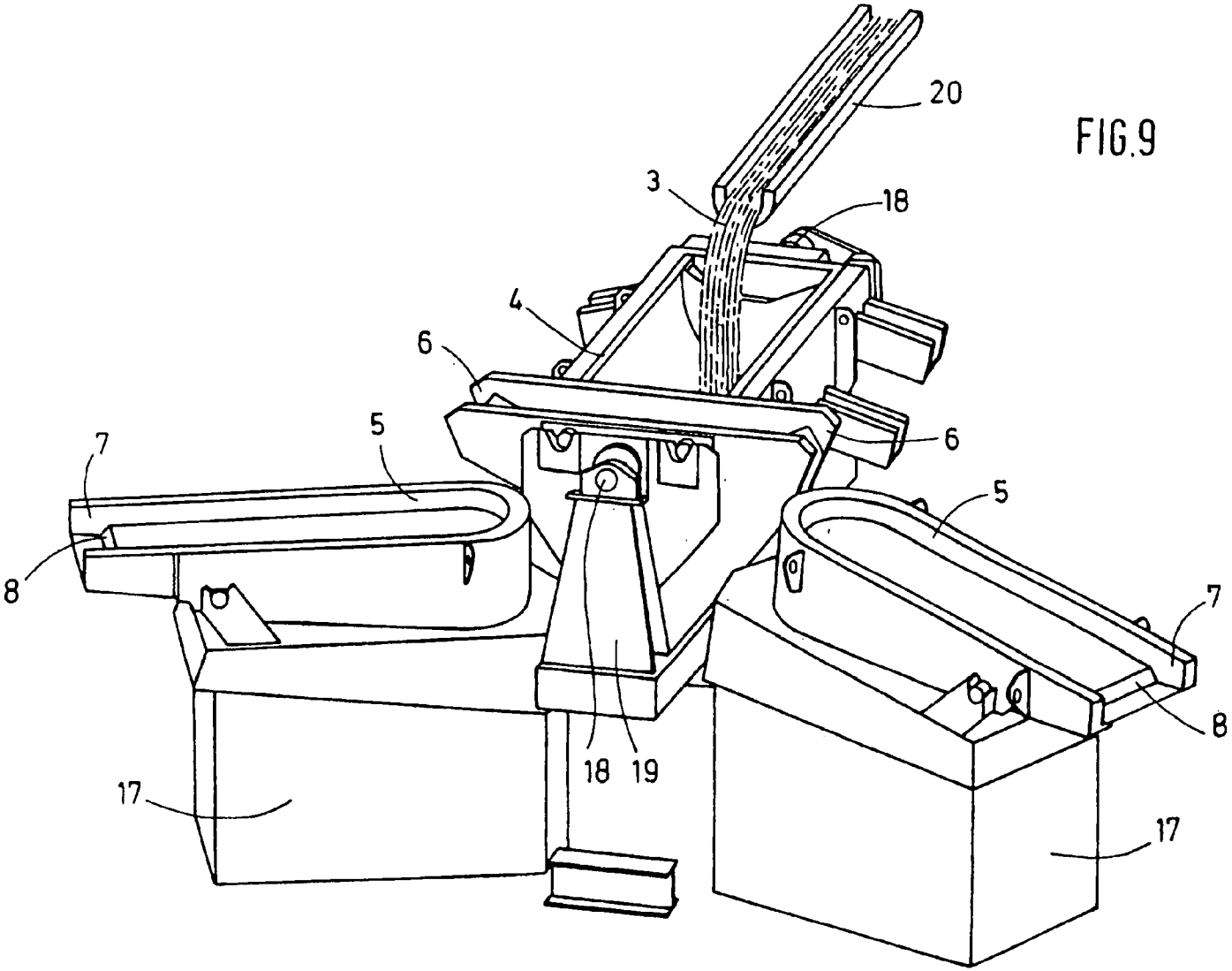
FIG. 9 shows a perspective view of the casting device.

The above description must be supplemented by noting that above the actual casting device 1, a container 3' of any desired design for holding molten metal 3 is provided, which, when it is tilted, allows a directed stream of molten metal to flow out into a feed channel 20, which fills the intermediate trough 4, as FIG. 3 shows. The present weight is monitored by supporting the support frame(s) 15, or 15 and 16, on the three weighing cells 13. FIG. 4 shows a metering trough 5, 5' with a front pouring spout 7, which is shown enlarged in FIG. 6. The metering trough 5, 5' in FIG. 4 is supported on the swivel bearing y—y and can be adjusted with the tilting cylinder 12 into the tilted inclination shown in FIG. 5. FIG. 7 and FIG. 8 show the laterally tiltable intermediate trough 4, 4' from different viewing directions. The same parts in each of these drawings are labeled with the same reference numbers.

The method of operation of the casting machine described above is explained below. The operating method comprises the following steps:

(a) An amount of molten metal with a predeterminable weight is fed from an anode furnace into an intermediate trough 4, 4' of a casting machine, and the mass flow rate of the molten metal is controlled by the adjustable opening of a furnace gate. The continuously determined weight of the dynamically increasing mass of the molten metal flowing into the intermediate trough 4, 4' is used as the controlled variable here.

(b) Molten metal is fed into a pair of metering troughs 5, 5' by tilting the intermediate trough 4, 4' about its longitudinal axis alternately to both sides by means of, e.g., the tilting cylinder 11. After the first metering trough 5 has been filled according to the weight program, the intermediate trough 4' is tilted towards the second metering trough 5', and the predetermined weight of an anode to be cast is poured into the metering trough 5'. Weighing devices 13 strictly monitor the mass of the molten metal in the intermediate trough 4' as well as in the metering troughs, and the filling of the troughs is automatically controlled in this way.

The emptying of the metering troughs 5, 5' into one ingot mold 10 of the casting wheel at a time is effected by raising the rear end of a metering trough 5 by hydraulic cylinders 12, 12' by means of automatic position control mechanisms (not shown). This causes the troughs 5, 5' to be tilted about the axes y—y into an inclined emptying position.

The operation of filling the ingot mold from a metering trough is carried out in three phases:

Phase (1): Molten metal is first poured relatively slowly, i.e., at a low mass flow rate, into a given ingot mold. During this short period of reduced flow, splashing or overflowing of the metal is avoided, and erosion of the ingot molds is reduced, which prolongs their service life.

Phase (2): After a predetermined weight of molten metal in the associated ingot mold 10 has been reached, uniform filling is carried out at a higher mass flow rate.

Phase (3): After a predetermined weight of molten metal has again been reached in the associated ingot mold 10, slow residual filling of the associated ingot mold 10 is carried out to obtain the precise weight desired.

For this purpose, the point at which the flow of molten metal is interrupted is selected in such a way that the weight tolerance is maintained. Dependent process parameters for this are:

anode weights;

different output amounts of molten metal in a metering trough 5;

geometry of the metering trough;

in this regard, the casting edge 8, 8' of the metering trough 5, 5' is designed in such a way that the kinetic energy is reduced during the tilting operation, and the molten metal flows as vertically as possible into the ingot mold.

One metering trough 5 or 5' at a time is alternately filled from the intermediate trough 4, 4', while the slow, exactly weight-controlled filling of an ingot mold is being carried out by the other metering trough 5'.

LIST OF REFERENCE NUMBERS

1. casting machine
3. container/molten metal
4. intermediate trough
5. metering trough
6. outlet
7. front outlet
8. outlet edges
9. casting wheels
10. ingot molds
11. means for tilting the intermediate trough
12. means for tilting the metering troughs
13. means for weighing the content of intermediate troughs
14. means for weighing the content of metering troughs
15. lower part of the support frame
16. upper part of the support frame
17. stand
18. swivel bearing
19. bearing brackets
20. feed channel

The invention claimed is:

1. Method for the exactly weight-controlled filling of ingot molds of a nonferrous casting machine, for example, a copper anode casting machine or a zinc anode casting machine, which is designed in the form of a fully mechanized casting operation with at least one casting wheel and is equipped with ingot molds, the method comprising the steps of: introducing molten metal into an intermediate trough (4, 4') at a regulated mass flow rate with simultaneous determination of the continuous dynamic weight increase; feeding molten metal alternately into metering troughs (5, 5') located on either side of the intermediate trough (4) by tilting the intermediate trough (4) first to one side and then to the other, and after the first metering trough (5) has been filled, tilting the intermediate trough (4) towards the second metering trough (5'), and at the same time casting the mass of an anode from the metering trough that was filled first into one of the ingot molds (10, 10') located on the casting wheel (9, 9') by a controlled tilting movement; and dividing the mass flow during casting into three phases, such that, in a first phase, the casting material is first cast into an ingot mold at a relatively low mass flow rate; in a second phase, after a predetermined metal mass or metal weight has been reached, uniform filling of the ingot mold (10) at a relatively higher mass flow rate is undertaken; and, in a third phase, after a predetermined weight of molten metal has again been reached, slow filling at a reduced mass flow rate is carried out to obtain the precise weight desired.

2. Method in accordance with claim 1, wherein only one metering trough (5) at a time is alternately filled from the intermediate trough (4), while the slow, exactly weight-controlled filling of an ingot mold (10) is being carried out by the other metering trough (5').

3. Method in accordance with claim 1, wherein, in the case of a triangular arrangement of the metering troughs (5, 5') on a casting wheel (9, 9'), only after both metering troughs are filled, are the next two empty ingot molds (10, 10') brought into position.

4. Method in accordance with claim 1, wherein, in the case of metering troughs (5, 5') arranged in the form of a Y on two casting wheels (9, 9'), while the filling operation of one metering trough (5) is still being performed, the next empty ingot molds (10, 10') are brought into position under the given presently filled metering trough (5).

5. Method in accordance with claim 1, wherein the period of time between the positioning of two ingot molds (10, 10') is calculated as the so-called cycle time from standing times of a casting wheel (9, 9') and moving times for positive or negative accelerations, for example, for filling, inspection, or removal, and overlapping of the moving times and especially of the filling is taken into consideration.

* * * * *